US005259791A

United States Patent [19]

Buck

[11] Patent Number: 5,259,791

[45] Date of Patent: Nov. 9, 1993

[54] COAXIAL CABLE SIDE TAP CONNECTOR ASSEMBLY AND PROCESSES FOR ASSEMBLY

[75] Inventor: Steven K. Buck, Buda, Tex.

[73] Assignee: W. L. Gore & Associates, Inc., Newark, Del.

[21] Appl. No.: 939,290

[22] Filed: Sep. 1, 1992

Related U.S. Application Data

[63] Continuation-in-part of Ser. No. 833,687, Feb. 11, 1992, Pat. No. 5,163,852.

[51] Int. Cl.[5] ..... H01R 9/07

[52] U.S. Cl. ..... 439/578; 439/736; 439/98; 29/856; 29/863

[58] Field of Search ..... 439/578-585, 439/675, 98, 99, 620, 736, 874, 394, 492; 29/860, 863, 666, 686, 828, 856

[56] References Cited

U.S. PATENT DOCUMENTS

| | | | |
|---|---|---|---|
| 2,805,399 | 9/1957 | Zeeper | 439/582 |
| 3,135,571 | 6/1964 | Klinkowitz | 459/582 |
| 4,464,583 | 8/1984 | Holmgren | 439/79 |
| 4,615,114 | 10/1986 | Jones et al. | 29/867 |
| 4,691,976 | 9/1987 | Cowen | 439/582 |
| 4,927,387 | 5/1990 | Eckler et al. | 29/867 |

*Primary Examiner*—David L. Pirlot
*Attorney, Agent, or Firm*—Gary A. Samuels

[57] ABSTRACT

A coaxial cable side tap assembly of a coaxial cable with pins separately attached to the cable center conductor and braided sheath for connecting to a branch cable or an integrated circuit or transducer microchip and processes for manufacture thereof.

6 Claims, 4 Drawing Sheets

COAXIAL CABLE SIDE TAP CONNECTOR ASSEMBLY AND PROCESSES FOR ASSEMBLY

RELATED APPLICATION

This application is a continuation-in-part of an application Ser. No. 07/833,687, filed Feb. 11, 1992, now U.S. Pat. No. 5,163,852.

FIELD OF THE INVENTION

The invention relates to side tap connector assemblies for tapping into a coaxial electric signal cable at any point for attachment of integrated circuit chips and to processes for assembling the connector, coaxial cable, and chip.

BACKGROUND OF THE INVENTION

In the provision of wiring systems carrying voice, electronic data, and/or electrical power between separate buildings, communication or data equipment and networks, or work stations within a building, it is frequently needed to splice or branch coaxial electric cables. Splicing is usually done by tapping into a coaxial cable along its length at a convenient point for branching. This can become tedious, complicated, and time consuming where the tap connectors are complicated and/or bulky and require special tools and skills for installation.

Several methods are currently used to tap a coaxial cable. One method is to cut the coaxial cable, terminate each end with a connector, and connect each connector to a tee connector. This method often gives a bulky and labor intensive connection. In a second method, the jacket, shield, and insulation are stripped from a short section of coaxial cable. The exposed center conductor is soldered to the exposed center conductor of a second coaxial cable, the shields connected by jumper wire, and the splice covered with insulation. This method is usually labor intensive, and the mechanical integrity of the coaxial cable is reduced since the braided shield, a primary strength member, has been cut.

A third method utilizes coaxial solder sleeves to tie in a third coaxial cable after the coaxial cable has been cut in two. Poor electrical characteristics and poor mechanical strength usually characterize the product of this method.

One may also cut and strip a coaxial cable and solder each center conductor to a pin on a small printed circuit (PC) board. The braids are soldered to pads on the board and onto a metal cover. The inside of the cover is incapsulated in insulation. The two pins protruding from the rear side of the PC board may connect to a branch coaxial cable. This product has good electrical properties, but only fair mechanical properties, and is usually a bit bulky.

A frequently used method is a saddle clamp device attached to a coaxial cable from which pointed contacts pierce the cable to contact the shield and the center conductor. Unreliable contact is often a problem with this method.

SUMMARY OF THE INVENTION

The invention comprises a coaxial cable side tap assembly with an integrated circuit chip.

The coaxial cable comprises an electrically-conductive center conductor surrounded by insulation (dielectric), which is preferably expanded polytetrafluoroethylene (ePTFE). The insulation is surrounded by a braided electrically-conductive sheath and optionally a protective polymer jacket around the shield.

The assembly of the invention is manufactured by removing the jacket from a short section of cable at a point where a tap is desired and tinning or soldering the conductive braid, preferably of a metal strand, wire, or strips of copper, copper alloy, aluminum, or steel, for example, to hold all strands of braid in place. Conductive epoxy resin may also be used in place of solder to hold the strands of braid in place. A small notch is cut from opposing sides of the tinned braid leaving intact the center conductor. The insulation (dielectric) is removed from the center conductor in the area of the two notches in the braid, such as by laser beam cutter. A notched insulated conductive pin is soldered at the notch to the center conductor, extending outwardly therefrom. The insulation of the pin extends at least to the outer surface level of the jacket. The cavity around the pin and center conductor is filled with insulation. A cylindrically-curved conductive top cap, having optionally already soldered in place a conductive pin or a formed raised pad for contacting the conductive braid of the cable and an adjacent hole for passage through the top cap of the insulated pin soldered to the center conductor, is placed over said insulated pin soldered to the center conductor in the opening in the braid of the cable and the cap soldered or adhered with conductive epoxy resin to the braid. A cylindrically-curved conductive bottom cap is placed on the opposite side of the cable from the top cap and soldered or adhered with conductive epoxy resin to the braid. The exposed area may then be covered with insulating protective polymer, such as by injection molding or shrink tubing.

Alternatively, the tap may be applied to the coaxial cable before application of a protective polymer outer jacket.

In this invention, the above described side tap is connected to a small integrated circuit microchip or transducer to form an integral part of a cable side tap microchip assembly under a plastic outer protective jacket covering the entire assembly. Optionally, the microchip under the jacket may have means provided for connection outside the assembly and may have a thin layer of insulation inserted between the microchip or transducer and the conductive braid surrounding the insulation and top and/or bottom portions of a conductive cap.

DETAILED DESCRIPTION OF THE INVENTION

The assembly of the invention and the processes for its manufacture are now described with reference to the drawings to more fully and carefully delineate the components of the assembly and how they are assembled together by the processes of the invention.

Figure 1A:
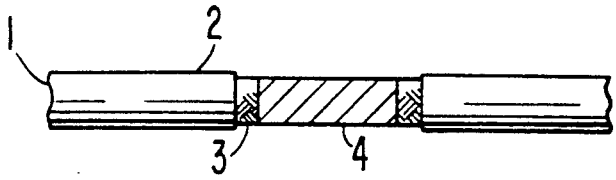
FIG. 1*a* is a side view of a coaxial cable 1 with a section of jacket 2 removed and the braid tinned at 4. The alternative form 1B has no jacket.
Figure 1B:
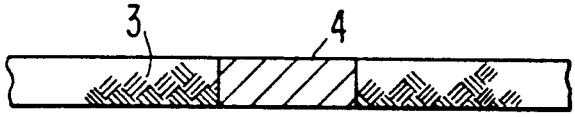

FIG. 1 shows jacketed A and unjacketed B forms of a coaxial cable 1 in which jacket 2 has been removed from a section of cable 1. A section of exposed conductive braid 3 is tinned 4 to hold the strands comprising the braid firmly in place.

Figure 2A:
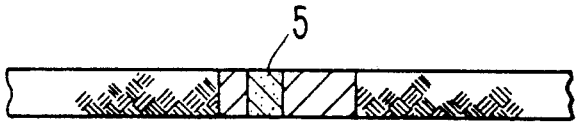
FIG. 2A is a side view of a coaxial cable with notches 6 cut through the tinned braid 4 to expose insulation 5.
Figure 2B:
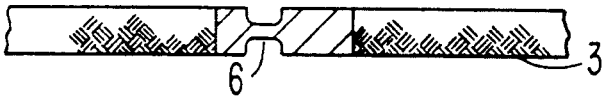
FIG. 2B depicts the cable of FIG. 2B rotated 90° to give a better view of the notches 6.

In FIG. 2, notches 6 have been cut partially through the tinned braid 4 opposite each other to expose the main cable dielectric 5. Views 2A and 2B are rotated 90° apart for better viewing of the exposed cross-section.

Figure 3A:
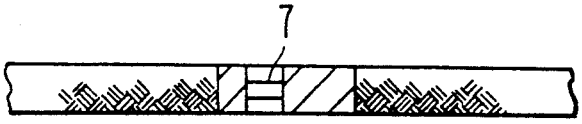
FIGS. 3A and 3B are side views of a cable showing the insulation removed from around the center conductor 2 in two 90° rotated views (E & F).
Figure 3B:
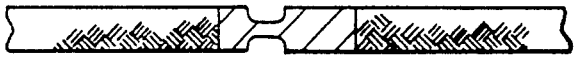

In FIG. 3, dielectric 5 has been removed from around center conductor 7, by laser beam, for example. Other removal methods may be used. Views 3A and 3B are rotated 90° apart.

Figure 4:
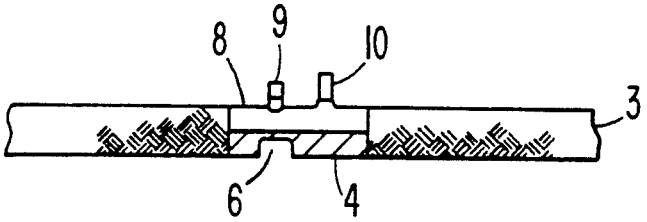
FIG. 4 is a side view of a cable having an insulated notched pin 9 soldered to the center conductor and passing through a top cap 8 fitted to the tinned braid, the top cap having a pin 10 soldered to it adjacent the exit of the notched pin through the top cap.

FIG. 4 shows a cylindrically-curved top cap 8 fitted to and soldered to the tinned braid 4 over notch 6. Insulated notched pin 9 has been fitted over center conductor 7 and soldered in place and passed through a hole for housing the insulated pin in the top cap 8. Pin 10 for contacting the braid 3 has been soldered to top cap 8 adjacent pin 9. Notch 6 lies beneath pin 9 soldered to center conductor 7.

Figure 5:
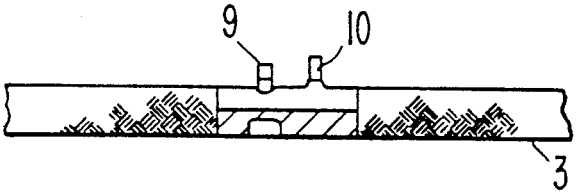
FIG. 5 is a side view of the partial assembly wherein insulation has been filled into the cavity formed by notch 6 surrounding the notched pin and center conductor.

In FIG. 5, the cavity surrounding pin 9 has been filled with insulation.

Figure 6:
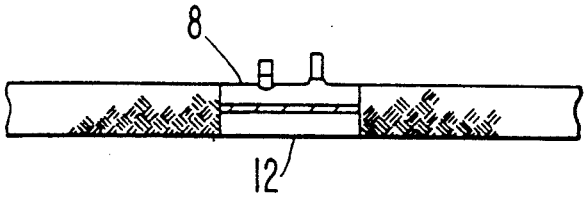
FIG. 6 is a side view of the assembly with top cap and bottom cap in place on the tinned portion of the cable.

FIG. 6 shows bottom cap 12 fitted over filled lower notch 6. It is soldered to braid 3 to complete the assembly.

At this point, protective polymeric jacket material may be applied to the assembly around the top and bottom caps in the area where it has been removed at the start of the manufacturing process. If the cable has no jacket, a jacket may now be applied over the cable and side tap assembly, such as by extrusion, to protect the cable and assembly while leaving the ends of the top contacts 9 and 10 exposed for connection to a cable branch.

Figure 7:
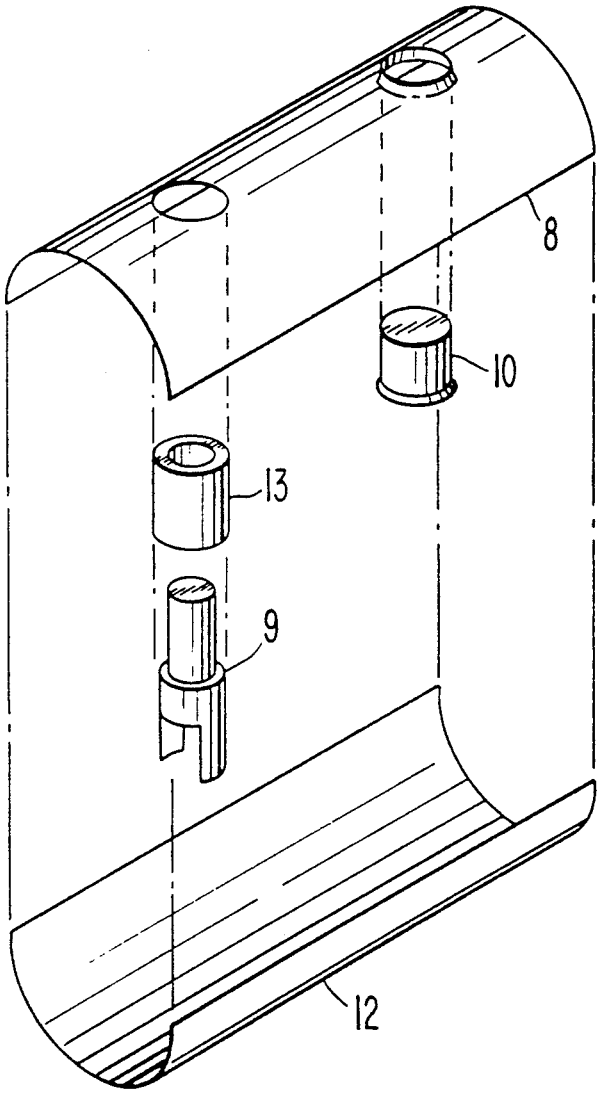
FIG. 7 is a blown up perspective view of the top cap, bottom cap, and insulated notched pin in spatial relationship to each other.

FIG. 7 shows a blown up perspective diagram of the spatial relationship of the top cap 8 to the bottom cap 12, and that of the insulator sleeve 13 to notched pin 9 and the hole for its passage through top cap 8. The relation of pin 10 to top cap 8 is also shown. The pins may be level with or extend above a protective jacket applied to the top and bottom caps or may lie below the jacket to be later located, opened and the ends of the pins placed in contact with outside terminals. Notched pin 9 is soldered to the center conductor 7 of the cable being tapped.

Figure 8:
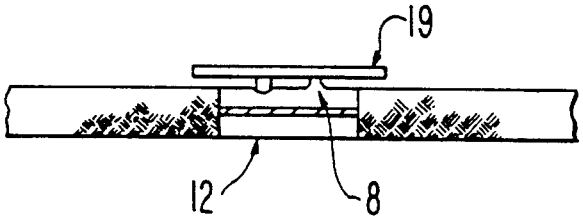
FIG. 8 is a side view of a top half and a bottom half of a cylindrically-shaped conductive cap with contact pins extending from the top cap to bring the outer conductor and the conductive braid of the shielded cable into contact with an integrated circuit chip or transducer affixed to the contact pins.

FIG. 8 shows a side view of a cable with side tap in place, such as depicted in FIG. 6, with an integrated circuit chip 19 affixed in place on the contact pins of the side cap in electrical contact with the circuits of the cable upon which the side tap is assembled.

The integrated circuit chip 19 may be a central processor wafer of about 0.2 inch by about 0.2 inch or less in dimensions. Such a chip contains the interconnected components: the clock; a control unit comprising the program counter, the instruction register, process status word, and stack pointer; a control memory; a bus control; a working register; an arithmetic/logic unit; and an internal memory or stack. Chip 19 may be a transducer.

The conductive metals known to be useful in coaxial signal cables are useful in this invention. The insulation of the cable may be any useful insulation (dielectric), but a foamed or expanded insulation, especially of ePTFE, is preferred for the cable used in this invention. The jacket may be of a material common in wire and cable manufacture, such as a thermoplastic fluorocarbon resin, polyethylene, polypropylene, polyurethane, or rubber, for example.

The assemblies of the invention are easily manufactured by the processes of the invention, are very light in weight, have a minimum cross-section, virtually the same as that of the coaxial cable used to make the assemblies, are very strong, and provide a minimum of protruding parts outside the surface contours of the coaxial cable. Easy and rapid connection and termination to a branch coaxial cable, tranducers, or microchips are provided. The assembly is useful in towed underwater sensors, such as those used in sonar arrays, and other areas of application include industrial sequence controllers, machine tool controllers, point-of-sale terminals, intelligent terminals, instrument processors, traffic light controllers, weather and seismic data collection systems, and process controllers.

I claim:

1. An assembly of a coaxial cable side tap assembly with a microchip comprising:

(a) a coaxial cable side tap assembly further comprising:

(i) a coaxial electric cable comprising an electrically-conductive center conductor surrounded by insulation, said insulation surrounded by an electrically-conductive braided shield, said shield optionally surrounded by a protective polymer jacket;

(ii) a solder or conductive epoxy coating covering the surface of a selected section of said braid; a pair of notches cut partially through said solder-coated surface portion of said braid opposite each other to leave said center conductor and portions of braid and insulation between said notches intact;

(iii) a longitudinally-curved electrically conductive top cap soldered or adhered by conductive epoxy resin to one side of said solder coating or said conductive epoxy coating on said braid over one of said notches in said braid, said top cap having two adjacent holes penetrating said cap or one hole penetrating said cap and one raised pad formed onto said cap along its length;

(iv) a first electrical contact pin, notched at one end to straddle said center conductor of said cable and soldered thereto, and of a length to fit and extend outwardly through a hole in said top cap, said pin being surrounded by insulation extending from said notch to the outer end of said pin;

(v) a second electrical contact pin soldered to the optional remaining hole in said top cap;

(vi) insulation filled into the cavity surrounding said center conductor and said notched pin at their soldered juncture;

(vii) an electrically-conductive longitudinally-curved bottom cap soldered or adhered by conductive epoxy resin to said solder coated braid or said conductive epoxy coated braid opposite said top cap;

(viii) an optional extruded protective polymer jacket surrounding said assembly to leave said pins exposed on the surface of said jacket;

(ix) a conductive braided sheath surrounding said insulation and said cap;

(b) an integrated circuit or transducer microchip in electrical contact with said first and second electrically-conductive pins; and (c) optionally a protective polymer jacket enclosing said side tap assembly and said microchip.

2. An assembly of claim 1 wherein said insulation of said cable comprises expanded polytetrafluoroethylene.

3. A process for manufacture of an assembly of a coaxial cable side tap assembly with an integrated circuit or transducer microchip comprising the steps of:

(a) removing a specified segment of jacket from a coaxial electric cable comprising an electrically-conductive center conductor, insulation surrounding said center conductor, electrically-conductive braided shield surrounding said insulation, and optionally an extruded protective polymer jacket surrounding said braid;

(b) soldering or imbedding in conductive epoxy resin said exposed area of braid to hold the strands of said braid in place;

(c) notching on both opposite sides partially through said soldered braid and underlying insulation to leave a narrow center portion of insulation and center conductor;

(d) removing said insulation underlying said notches;

(e) soldering to said center conductor the notched end-of an insulated pin;

(f) attaching a laterally-curved top cap, bearing two holes aligned longitudinally in its surface, by soldering said cap to said soldered braid or affixing said cap by conductive epoxy resin to said conductive epoxy resin imbedded braid over said notch and said insulated pin, then soldering a pin to the remaining hole in said top cap or alternatively soldering said pin to said cap prior to fitting to said braid;

(g) filling the cavity surrounding the soldered notched pin and its joint with said center conductor with insulation;

(h) attaching a laterally-curved bottom cap to the braid on the opposite side of said top cap by soldering it thereto or by affixing it by conductive epoxy resin thereto;

(i) attaching an integrated circuit microchip to the outer end of said notched insulated pin and said pin soldered to said remaining hole in said top cap; and (j) optionally, enclosing said assembly in protective polymeric jacketing material.

4. An assembly of a coaxial cable side top assembly with a microchip comprising:

(a) a coaxial cable side top assembly comprising:

(i) an electric cable comprising an electrically-conductive center conductor surrounded by insulation, said insulation having a short section removed from around said center conductor;

(ii) a cylindrically-curved plastic cap of the same curvature as said insulation fitted over said cable at the point of removal of said short section of insulation;

(iii) said cap having imbedded therein and penetrating it perpendicularly a first electric contact pin, the inside end of which pin is notched to fit over said center conductor, and which notch is soldered to said center conductor;

(iv) said cap having a plastic hump molded about said first contact pin on the outside surface of said cap to aid in holding said pin in place in said cap and to aid in deflecting strands of conductive braid wire around and out of electrical contact with said first pin;

(v) said cap having affixed to its outer surface a second electrical contact pin for electrically contacting a conductive braided sheath surrounding said insulation and said cap;

(vi) an area of optional conductive metal plating on the outside surface of said cap surrounding said second pin;

(vii) insulation comprising the same or different insulation to that of the insulation surrounding said conductor filling the removed section of insulation surrounding said center conductor and surrounding said first pin soldered to said center conductor;

(viii) a conductive braided sheath surrounding said insulation and said cap;

(b) an integrated circuit or transducer microchip in electrical contact with said first and second electrical contact pins of said cap; and (c) an optional protective polymer jacket surrounding said cable, said cap, and said microchip.

5. An assembly of claim 4 wherein said insulation surrounding said center conductor comprises expanded polytetrafluoroethylene.

6. A process for manufacture of an assembly of a coaxial cable side tap assembly with an integrated circuit or transducer microchip comprising the steps of:

(a) removing a specified segment of insulation from an insulated electrically-conductive center conductor;

(b) placing thereon over the cavity formed by removal of said segment of insulation a cylindrically-curved plastic cap of the same curvature as said insulation;

(c) said cap having imbedded therein and penetrating it perpendicularly a first electric contact pin, the inside end of which pin is notched to fit over said center conductor;

(d) said cap having a plastic hump molded about said first contact pin on the outside surface of said cap to aid in holding said pin in place in said cap and to aid in deflecting strands of conductive wire braid around and out of electrical contact with said first pin;

(e) said cap having affixed to its outer surface a second electrical contact pin for electrically contacting a conductive braided sheath surrounding said insulation and said cap and an area of optional conductive metal plating on the outside surface of said cap surrounding said second pin;

(f) soldering said notch of said first pin to said center conductor;

(g) filling the cavity created by removal of insulation surrounding said center conductor with the same or different insulation as that surrounding said center conductor and surrounding said soldered notch, said first pin, and said center conductor;

(h) braiding a conductive sheath around said insulation surrounding said center conductor and said cap;

(i) attaching in electrical contact an integrated circuit or transducer microchip to the outer ends of said first and second contact pins; and optionally surrounding said conductive braid and said microchip with a protective polymer jacket.

* * * * *